US007755547B2

(12) United States Patent
Rahola et al.

(10) Patent No.: US 7,755,547 B2
(45) Date of Patent: Jul. 13, 2010

(54) MECHANICALLY TUNABLE ANTENNA FOR COMMUNICATION DEVICES

(75) Inventors: Jussi Rahola, Espoo (FI); Jani Ollikainen, Helsinki (FI); Keniche Hashizume, Gunma (JP); Matti Ryynänen, Helsinki (FI)

(73) Assignee: Nokia Corporation, Espoo (FI)

( * ) Notice: Subject to any disclaimer, the term of this patent is extended or adjusted under 35 U.S.C. 154(b) by 863 days.

(21) Appl. No.: 11/478,839

(22) Filed: Jun. 30, 2006

(65) Prior Publication Data

US 2008/0001829 A1 Jan. 3, 2008

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846, 895
See application file for complete search history.

(56) References Cited

U.S. PATENT DOCUMENTS

| | | | | |
|---|---|---|---|---|
| 4,214,246 | A | 7/1980 | Arechavala | 343/750 |
| 4,460,896 | A * | 7/1984 | Shmitka | 343/750 |
| 4,495,503 | A * | 1/1985 | Morman | 343/746 |
| 5,923,305 | A * | 7/1999 | Sadler et al. | 343/895 |
| 6,195,048 | B1 * | 2/2001 | Chiba et al. | 343/700 MS |
| 6,239,751 | B1 * | 5/2001 | McRae et al. | 343/700 MS |
| 6,700,540 | B2 * | 3/2004 | Holshouser | 343/700 MS |
| 6,844,852 | B1 | 1/2005 | Simons | 343/700 |
| 2002/0097183 | A1 | 7/2002 | Weinbrenner | 342/359 |
| 2003/0098812 | A1 * | 5/2003 | Ying et al. | 343/702 |
| 2003/0151555 | A1 * | 8/2003 | Holshouser | 343/700 MS |
| 2003/0169209 | A1 * | 9/2003 | Ohara et al. | 343/895 |
| 2004/0125029 | A1 | 7/2004 | Maoz et al. | 343/702 |
| 2007/0194995 | A1 * | 8/2007 | Fang et al. | 343/702 |
| 2007/0241969 | A1 | 10/2007 | Audrenko et al. | 343/700 |

FOREIGN PATENT DOCUMENTS

| | | |
|---|---|---|
| EP | 1 108616 A2 | 6/2001 |
| JP | 63263802 | 10/1988 |
| JP | 1-129602 | 5/1989 |
| JP | 2005333203 | 12/2005 |
| WO | WO92/09163 | 5/1992 |
| WO | WO 93/06631 | 4/1993 |
| WO | WO 01/31740 | 5/2001 |
| WO | WO 02/089251 | 11/2002 |
| WO | WO 03/007427 | 1/2003 |
| WO | WO 03/058758 | 7/2003 |
| WO | WO2004/097976 | 11/2004 |
| WO | WO 2005/099040 | 10/2005 |

* cited by examiner

*Primary Examiner*—HoangAnh T Le
(74) *Attorney, Agent, or Firm*—Ware, Fressola, Van Der Sluys & Adolphson LLP

(57) ABSTRACT

A radio antenna assembly for use in a communication device has an antenna element disposed adjacent to a ground plane to form a physical relationship with the ground plane. A mechanical device is used to change the physical relationship for changing the operating impedance of the antenna element or shifting the frequency band of the antenna assembly. The physical relationship can be changed by mechanically changing the shape of the antenna element. When the antenna element comprises a first radiating element and a second radiating element disposed at a lateral distance from the first radiating element, the physical relationship can be changed by changing the distance. When a physical object is disposed between the antenna element and the ground plane, the physical relationship can be changed by moving or twisting the physical object. The object can be electrically conducting, dielectric or magnetic.

13 Claims, 15 Drawing Sheets

MECHANICALLY TUNABLE ANTENNA FOR COMMUNICATION DEVICES

FIELD OF THE INVENTION

The present invention relates generally to a radio antenna and, more particularly, to an antenna which can be tuned to be operable in a variety of frequency bands.

BACKGROUND OF THE INVENTION

Mobile phones usually have antennas that are required to cover many frequency bands. For example, the GSM antenna may have to cover four bands, namely the two European bands called GSM 900 (880-960 MHz) and GSM 1800 (1710-1880 MHz), and two US bands called GSM 850 (824-894 MHz) and GSM 1900 (1850-1990 MHz). It is advantageous and desirable to provide an antenna which can be tuned between two states, wherein the European state covers GSM 900 and GSM 1800 and the US state covers GSM 850 and GSM 1900, for example.

Furthermore, it is advantageous to provide an antenna which can be tuned to optimize the antenna performance in different use situations. For example, the impedance of a mobile phone antenna may be detuned when the mobile phone is put next to the head of the user or covered by the user's hand. Also, the antenna operation may change when the phone is put on a table or inside a bag, or when the phone has moving parts with the parts located differently relative to each other. In many of these situations, the antenna may be required tuning in order to improve the antenna performance.

Similar applications of tunable antennas exist for base station antennas, access points and other wireless communication devices.

SUMMARY OF THE INVENTION

The present invention provides a radio antenna assembly having an antenna element disposed in relationship with a ground plane. The antenna element has a physical characteristic regarding the ground plane. A mechanical device is used to change the physical characteristic in order to change the operating impedance of the antenna element or to shift the frequency band of the antenna assembly. In one embodiment of the present invention, a mechanical device is used to change the shape of the antenna element. In another embodiment, the antenna assembly has an electrically conducting member, such as a metal strip, rod or plate, disposed adjacent to the antenna element for forming a physical characteristic between the antenna element, the electrically conducting member and the ground plane, and a mechanical device is used to change the physical relationship between the electrically conductive member and the antenna element and/or between the electrical conductive member and the ground plane. For example, the mechanical device can be used to change the distance between the electrically conductive member and the antenna element, or to change the shape of the electrically conductive member. The coupling between the antenna element and the ground plane can also be changed by altering the size or the shape of the ground plane.

When the antenna assembly is used in a communication device, such as a mobile phone, a change in the mechanical structure of the device body can be used to change the coupling characteristic of the antenna element and the device body.

Thus, the first aspect of the present invention is a radio antenna assembly having an antenna element disposed in relationship with a ground plane, forming a physical characteristic between the antenna element and the ground plane, wherein the physical characteristic can be mechanically changed.

The second aspect of the present invention is a method for tuning a radio antenna in a communication device, wherein the tuning can be achieved by using a mechanical device to change the physical relationship between an antenna element and the ground plane.

The third aspect of the present invention is a communication device, such as a mobile phone, wherein the antenna can be mechanically tuned by changing the coupling between the antenna element and a ground plane and/or the coupling between the antenna element and the device body.

The present invention will become apparent upon reading the description taken in conjunction with FIGS. 1*a* to 25.

DETAILED DESCRIPTION OF THE INVENTION

Figure 1B:
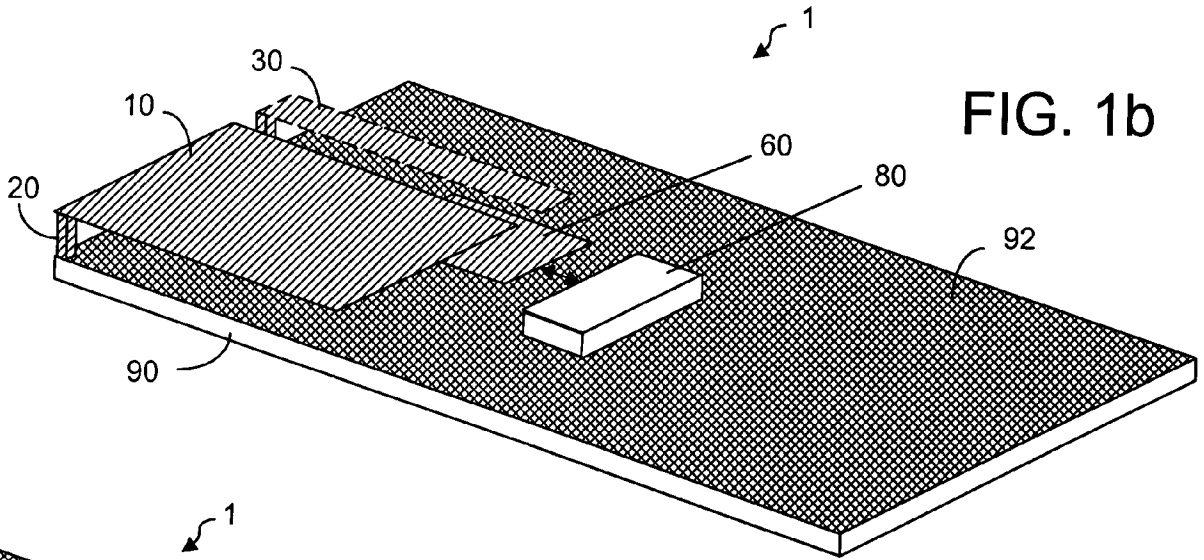
FIG. 1*b* is a schematic representation of a mechanically tunable antenna, according to another arrangement of the present invention.
Figure 1A:
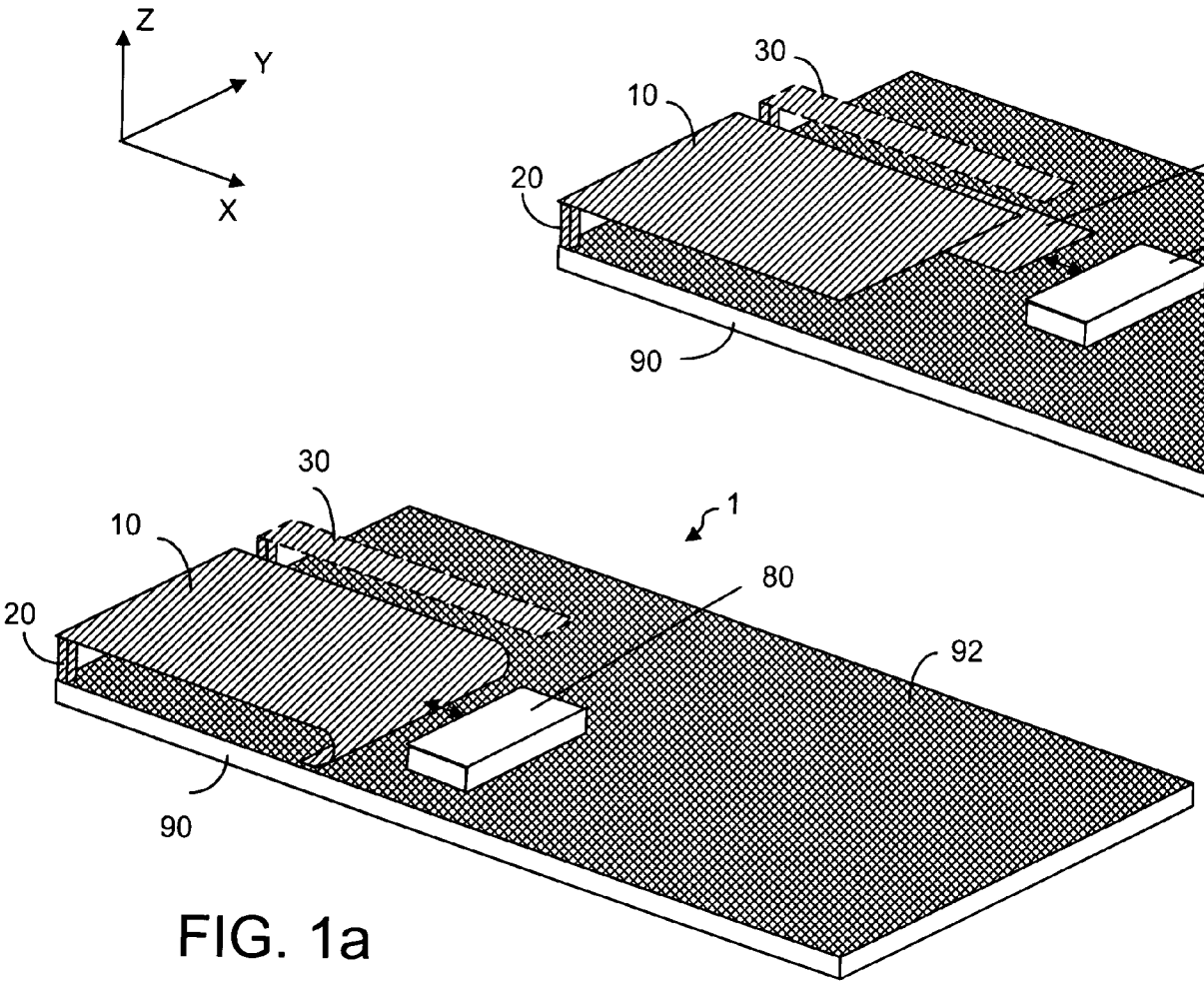
FIG. 1*a* is a schematic representation of a mechanically tunable antenna, according to one arrangement of the present invention.
Figure 18A:
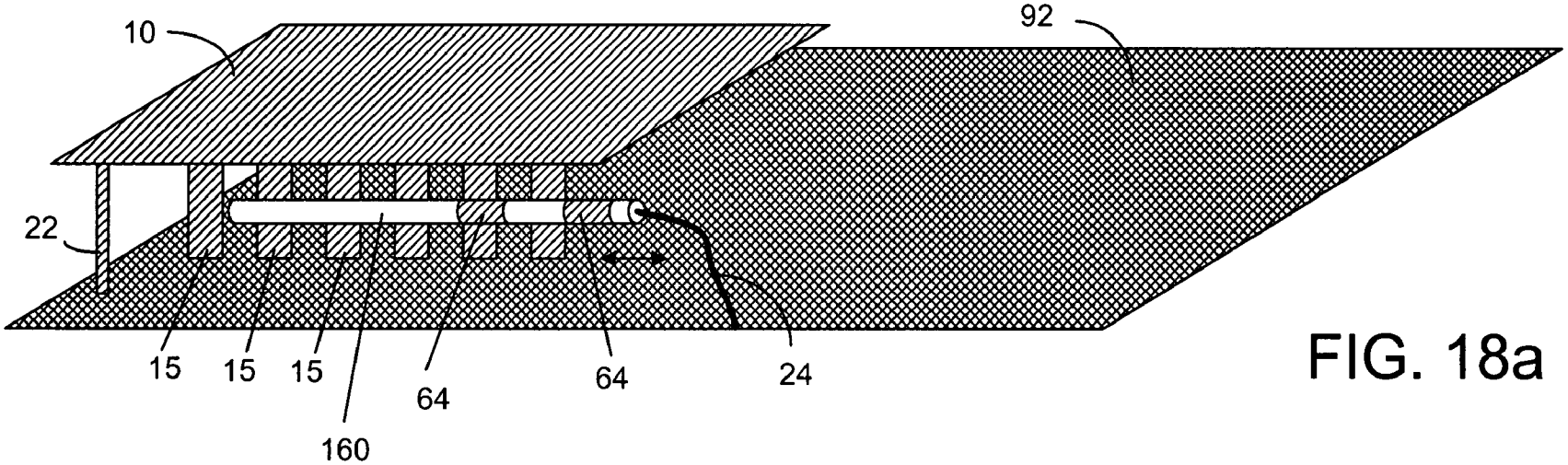
FIG. 18*a* is a schematic representation of an antenna having one or more metallic patches on a slidable feed rod for selecting the feed location.
Figure 18B:
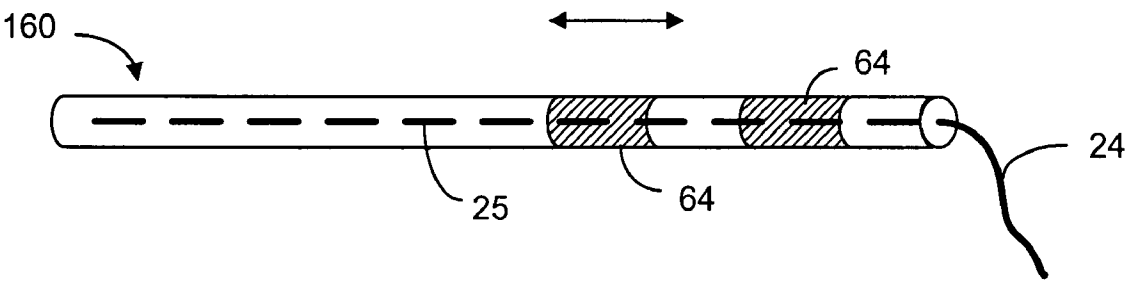
FIG. 18*b* shows the detail of the slidable feed rod.
Figure 19B:
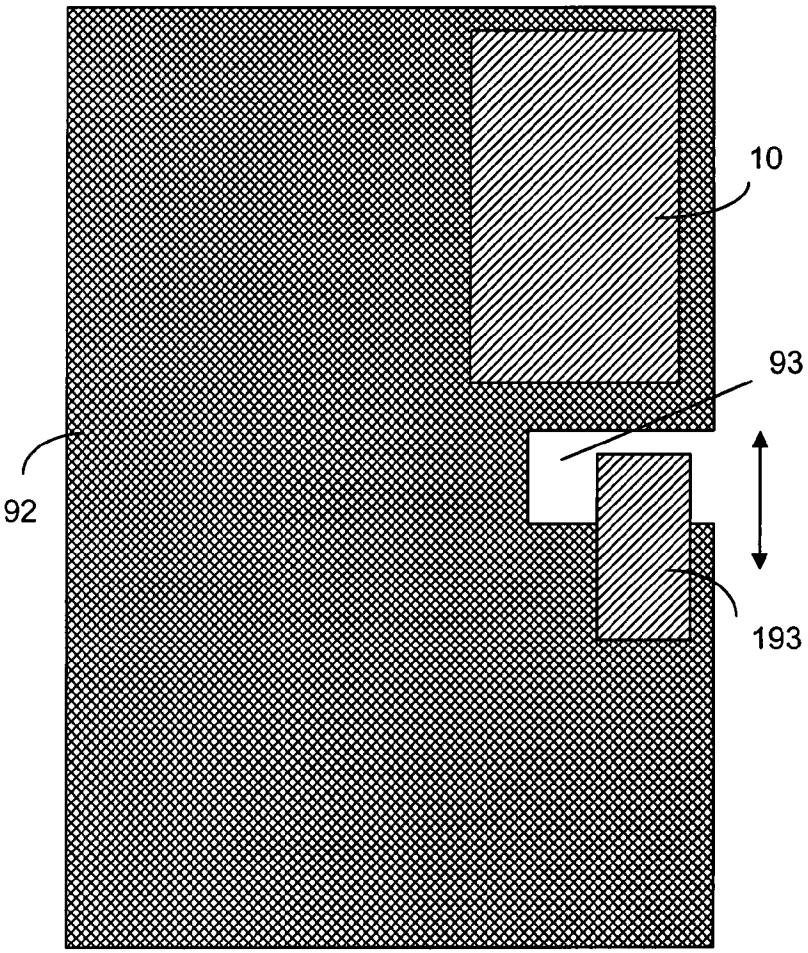
FIG. 19*b* is a schematic representation of antenna having a radiating element located adjacent to another tunable ground plane.
Figure 19A:
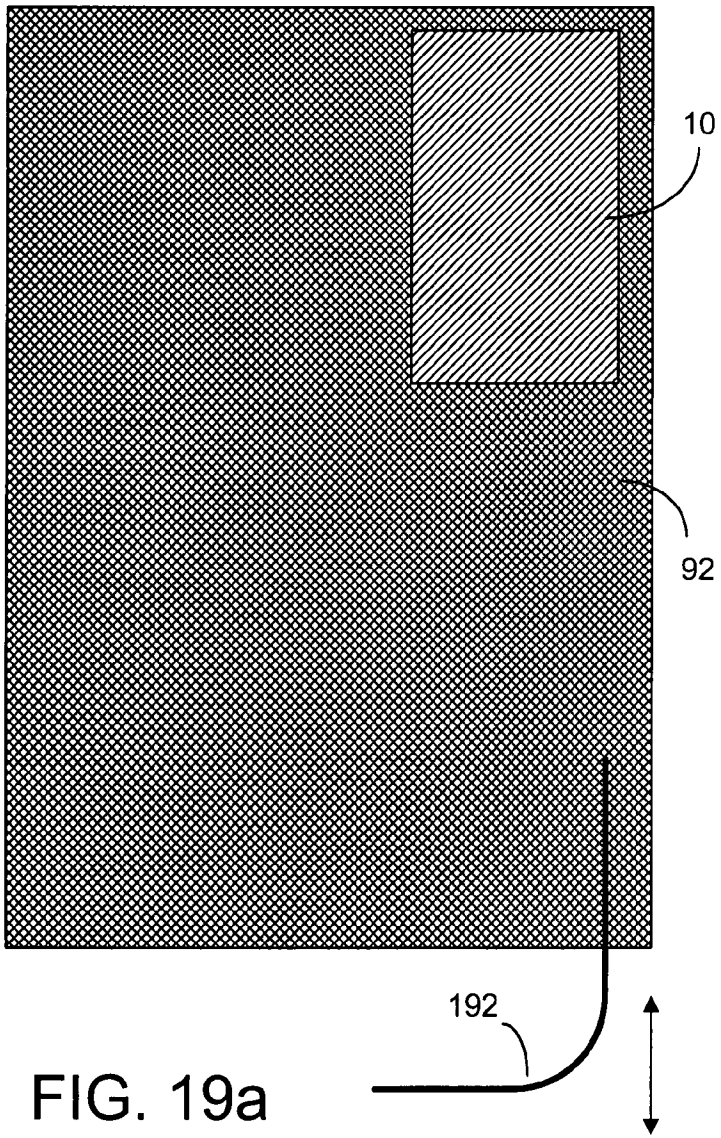
FIG. 19*a* is a schematic representation of antenna having a radiating element located adjacent to a tunable ground plane.

The mechanically tunable antenna, according to the present invention, can be implemented in many different ways, as illustrated in FIG. 2 to 24. In general, the mechanically tunable antenna can be tuned by a mechanical device which is used to change the shape of the radiation or antenna element, as shown in FIG. 1*a*. Alternatively, the antenna element is electromagnetically coupled to an electrically conductive object located nearby and the conductive object is caused by a mechanical device to change its shape or its location relative to the antenna element, as shown in FIG. 1*b*. In a mobile phone where the antenna can be used to cover two adjacent frequency bands, the change of the shape of the antenna element and the shape or location of the conductive object is designed to shift the resonant frequencies of the antenna from one frequency band to another. As such, each frequency band can have a narrow bandwidth. Also, more specifically by changing an antenna's input impedance not only the resonant frequency can be changed but also the quality of the impedance match, the bandwidth, and radiation efficiency can be changed or altered. The changing of the antenna element via an actuator also changes the physical relationship between the antenna radiating element and the ground plane. This is due to the fact that antennas are generally sensitive to their ground plane arrangements. Furthermore, it is possible to manipulate the ground plane itself, as shown in FIGS. 19*a* and 19*b*. The tuning of the antenna can also be achieved by changing the coupling between different parts of a mobile phone or by changing the position of the antenna on the mobile phone.

In the arrangement as shown in FIG. 1*a*, an antenna assembly 1 comprises an antenna element 10 disposed on a circuit board 90 having a ground plane 92. The antenna element 10 is operatively connected to a feed pin 20. Possibly, the antenna element 10 is also connected to a grounding or shorting pin 22 (see FIGS. 8*c*, 15 and 17*b*, 18*a*). The antenna assembly may have one or more parasitic radiating elements 30 located adjacent to the antenna element 10. As shown in FIG. 1*a*, a mechanical device 80 is used to change the shape of the antenna element 10, when needed. For example, the mechanical device 80 can be an actuator or a motor having a movable shaft directly or indirectly applying a force to a part of the antenna element 10. As such, part of the antenna element 10 can be bent, twisted or moved. The mechanical device can be located on the circuit board 90 on the same side as the antenna element 10, or the opposite side of the circuit board.

In the arrangement as shown in FIG. 1*b*, the antenna element 10 is electromagnetically coupled to a conductive or dielectric/magnetic member 60 located adjacent to the antenna element 10. The antenna assembly may have one or more parasitic radiating elements 30 located adjacent to the antenna element 10. A mechanical device 80 is used to change the shape or the location of the conductive or dielectric/magnetic member 60, when needed, thereby changing the electromagnetic coupling between the antenna element 10 and the ground plane 92. For example, the mechanical device 80 can be an actuator or a motor having a movable shaft directly or indirectly applying a force to a part of the antenna element 10. As such, part of the antenna element 10 can be bent, twisted or moved. The mechanical device can be located on the circuit board 90 on the same side as the conductive or dielectric/magnetic member 60, or the opposite side of the circuit board.

The mechanical tuning according to the arrangement as shown in FIG. 1*a* is illustrated in FIGS. 2, 3, 4, 12*c* and 13*b*. The mechanical tuning according to the arrangement as shown in FIG. 1*b* is illustrated in FIG. 5*a*, 5*b*, 6, 7, 8*a*, 8*b*, 8*c*, 9, 10 and 16, where the change of an adjacent conductive or dielectric/magnetic element is designed to change the coupling between the antenna element 10 and the ground plane. When a parasitic element is located adjacent to the antenna element, the mechanical tuning can be achieved by changing the coupling between the antenna element and the parasitic element, as shown in FIG. 11. In FIGS. 12*a*, 12*b*, 13*a*, 14*a*-14*c*, 15, 17*a* and 17*b*, the coupling between the antenna element and the ground plane and/or the coupling between the antenna element and the parasitic element can be changed by moving an electrically conductive or dielectric/magnetic member relative to the antenna element.

Figure 2:
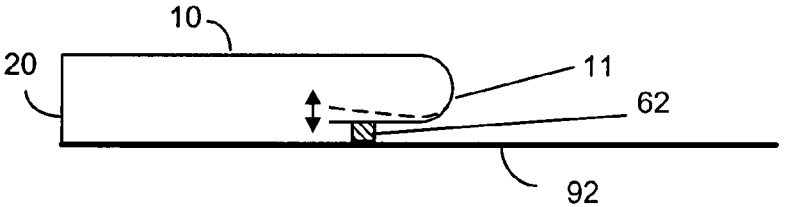
FIG. 2 is a schematic representation of a tunable antenna having a flexible radiating segment which can be bent by a mechanical device.

FIG. 2 is a schematic representation of an antenna having an antenna element 10 connect to a flexible radiating segment 11. Using an actuator 62 to push the end tip of the flexible radiating segment 11, the end tip of the flexible radiation segment 11 can be moved up and down relative to the ground plane 92.

Alternatively, the antenna element 10 is electrically connected to an end section 12 which can be rotated at a pivot point. Using an actuator to push the end section 12, the end section 12 can be rotated about the pivot point, as shown in FIG. 3.

Figure 4:
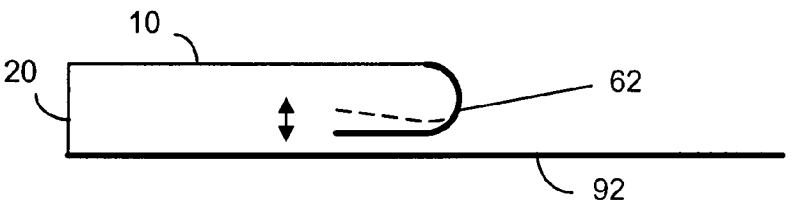
FIG. 4 is a schematic representation of a tunable antenna having a flexible radiating segment covered with an actuator material.

In FIG. 4, the end section of the antenna element is partially covered by an actuator element 62 for changing the shape of the antenna element 10. The width of the actuator element 62 can be the same as or different from the width of the antenna element 10.

Figure 3:
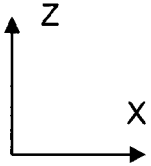
FIG. 3 is a schematic representation of a tunable antenna having a movable radiating segment which can be rotated by a mechanical device.
Figure 3:
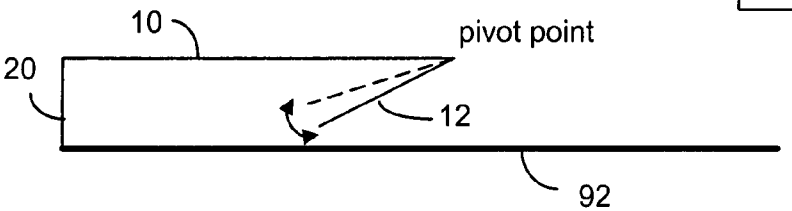

In FIGS. 2 to 4, the shape of the antenna element 10 at least partially determines the resonant frequency band or bands. Changing the shape of the antenna element 10 changes the physical characteristic of the antenna affecting the resonant frequencies. The extent of the shape change is determined by the desired frequency shift in an application. For example, if the antenna element in the original shape is designed to provide resonance at a first state, the antenna element in the altered shape provides resonance at a second state. One of these two states can be designed to cover European bands of GSM 900 (880-960 MHz) and GSM 1800 (1710-1880 MHz). The other state can be designed to cover the US bands of GSM 850 (824-894 MHz) and GSM 1900 (1850-1990 MHz), for example. As the present invention is by no means limited to GSM bands only, it may be desirable to cover other bands or protocols too, for example, CDMA, PDC, WCDMA, BLUETOOTH, WLAN, HLAN, GPS, WiMax, UWB, FM, RFID, DVB-H, DRM, DAB, AM and other Cellular and Non-Cellular radio systems.

Figure 5A:
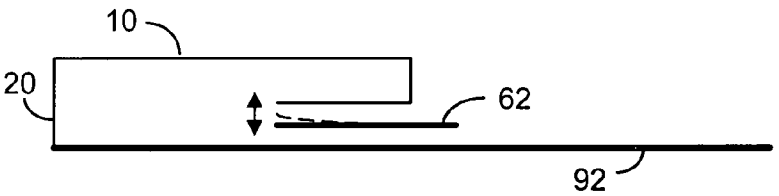
FIG. 5*a* is a schematic representation of a tunable antenna electromagnetically coupled to a conductive plate or an actuator which can be bent by a mechanical device.
Figure 5B:
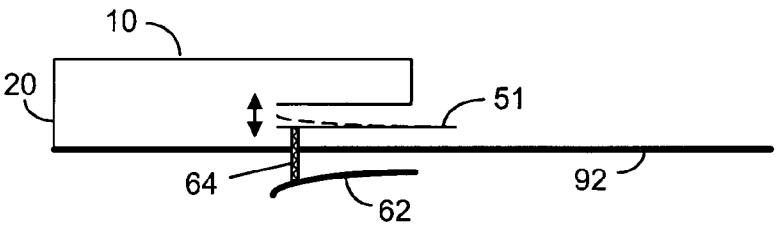
FIG. 5*b* is a schematic representation of a tunable antenna electromagnetically coupled to a conductive plate which can be bent by an actuator located on the opposite side of the circuit board.

In FIGS. 5*a* to 10, the shape of the antenna element 10 does not change in the tuning process. The antenna element 10 is electromagnetically coupled to an adjacent conductive element and the shape of the conductive element is caused to change by a mechanical device. As shown in FIG. 5*a*, the conductive element is an actuator 62 which is placed between the antenna element 10 and the ground plane 92. The actuator 62 is caused to bend so as to change the coupling between the antenna element 10 and the ground plane 92. The actuator 62 can also be placed on the other side of the ground plane 92, as shown in FIG. 5*b*. In that case, a metal plate or dielectric/magnetic body 52 is placed between the antenna element 10 and the ground plane 92 and the body 52 is linked to the actuator 62 by a pin 64 such that the body 52 can be caused to bend by the actuator 62.

Figure 6:
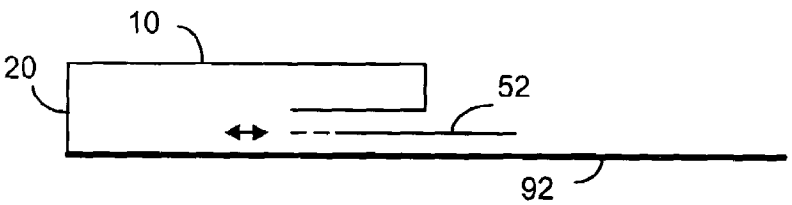
FIG. 6 is a schematic representation of a tunable antenna electromagnetically coupled to a conductive plate which can be shifted in a lateral direction by a mechanical device.
Figure 7:
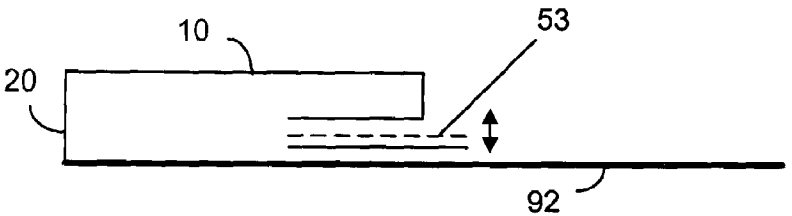
FIG. 7 is a schematic representation of a tunable antenna electromagnetically coupled to a conductive plate which can be moved up and down by a mechanical device.

In a different embodiment as shown in FIG. 6, the metal plate or dielectric/magnetic body 52 is laterally shifted by a mechanical device in a direction substantially parallel to the ground plane 92 to change the coupling between the antenna element 10 and the ground plane 92. In yet another embodiment as shown in FIG. 7, the metal plate or dielectric/magnetic body 52 is moved up and down by a mechanical device for changing the coupling.

Figure 8A:
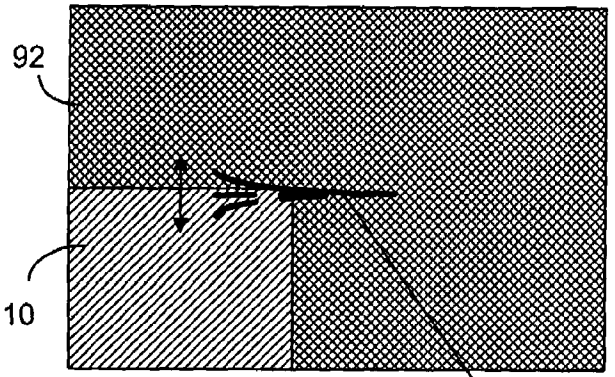
FIG. 8*a* is a schematic representation showing a plan view of a tunable antenna electromagnetically coupled to a vertical strip which can be bent by a mechanical device.
Figure 8B:
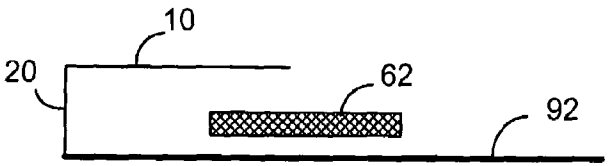
FIG. 8*b* is a schematic representation showing a side view of the tunable antenna of FIG. 8*a*.
Figure 8C:
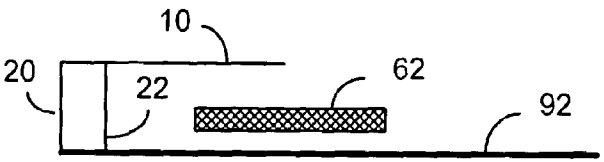
FIG. 8*c* is a schematic representation of an inverted-F antenna electromagnetically coupled to a vertical strip which can be bent by a mechanical device.

In the embodiment as shown in FIGS. 8*a* to 8*c*, a vertical metal strip 62 is used as an actuator and placed adjacent to the antenna element 10. The antenna element has a feed pin 20 and possibly a shorting pin 22. As shown in FIG. 8*a*, part of the actuator is located below the antenna element 10 when the actuator 62 is in one state. In another state, the actuator is bent outward away from the antenna element 10. In yet another state, the actuator is bent inward so that a larger part of the actuator is located beneath the antenna element. FIGS. 8*b* and 8*c* are side views showing the location of the actuator 62 relative to the antenna element 10 and the ground plane 92.

The antenna element 10 can be a part of a planar antenna with or without a grounding pin 22. Without the grounding pin 22, the antenna element 10 is a part of an inverted-L antenna (ILA), as shown in FIG. 8*b*. With the grounding pin 22, the antenna element 10 is part of an inverted-F antenna (IFA), as shown in FIG. 8*c*. The antenna element 10 can be either a narrow strip as in a normal inverted-L or inverted-F antenna or it can be a wide plate as in the case of a planar inverted-L antenna (PILA) or a planar inverted-F antenna (PIFA).

Figure 10:
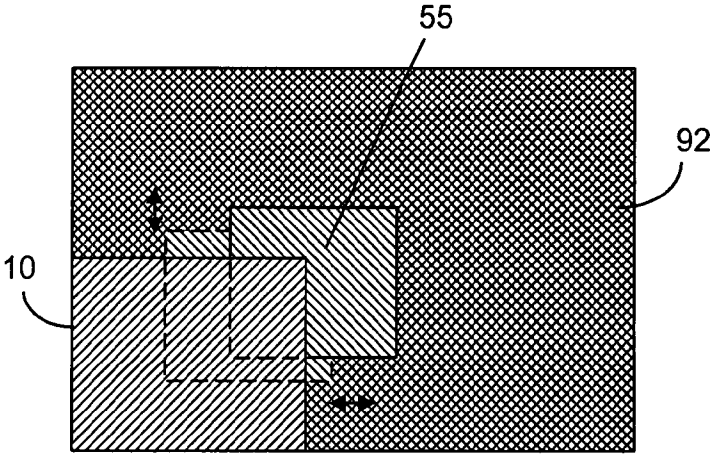
FIG. 10 is a schematic representation of a tunable antenna electromagnetically coupled to a conductive plate which can be laterally shifted under the antenna element.
Figure 9:
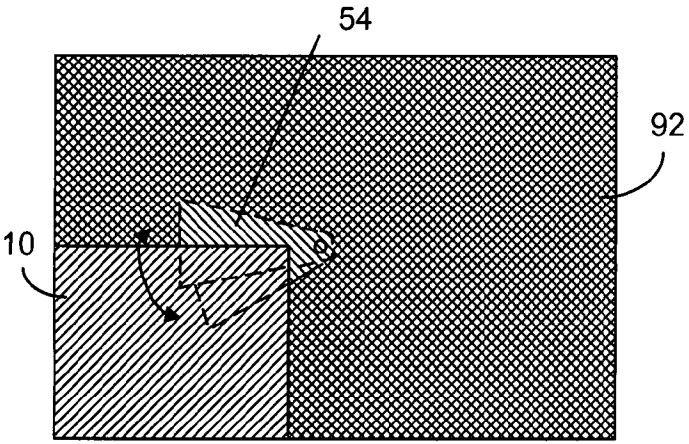
FIG. 9 is a schematic representation of a tunable antenna electromagnetically coupled to a conductive plate which can be swiveled under the antenna element.
Figure 11:
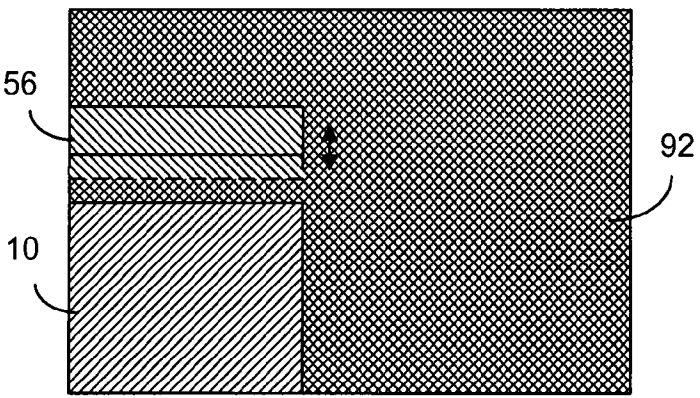
FIG. 11 is a schematic representation of a tunable antenna electromagnetically coupled to a parasitic antenna element which can be moved laterally by a mechanical device.

FIGS. 9 and 10 show two different embodiments of the present invention where a metal plate or dielectric/magnetic body is placed between the antenna element 10 and the ground plane 92 and part of metal plate or dielectric/magnetic body is laterally shifted to change the coupling between the antenna element 10 and the ground plane 92. As shown in FIG. 9, the metal plate or dielectric/magnetic body 54 is rotatably mounted at a pivot point so that it can be caused to shift by a mechanical device. The body 54 can be rotated by a motor, a curled bending actuator or a linear actuator.

As shown in FIG. 10, the metal plate or dielectric/magnetic body 55 is laterally shifted in one or more directions with an actuator, a motor or another mechanical device. Moreover, the body 55 can be moved in a direction perpendicular to the ground plane or tilted to form an angle with the ground plane 92.

In FIG. 11, the metal plate 56 is used as a parasitic element electromagnetically coupled to the antenna element 10. The parasitic element can be laterally shifted by a mechanical device so as to change the distance between the parasitic element and the antenna element 10.

Figure 12B:
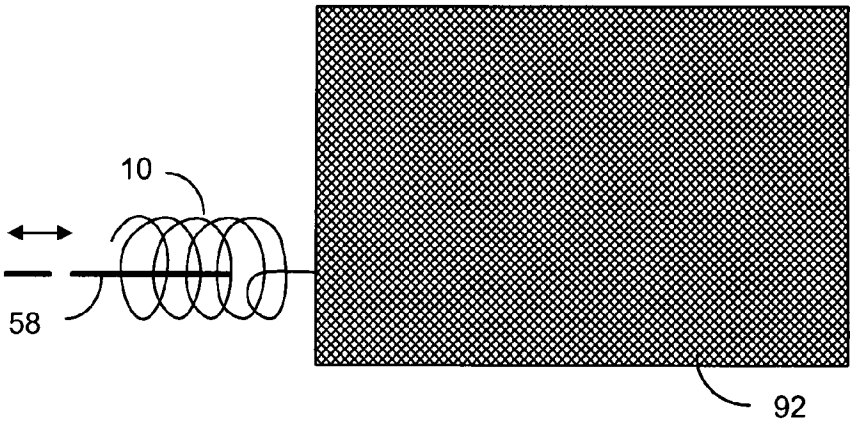
FIG. 12*b* is a schematic representation of a helix antenna mechanically tuned by moving a rod or object inside the helix.
Figure 12A:
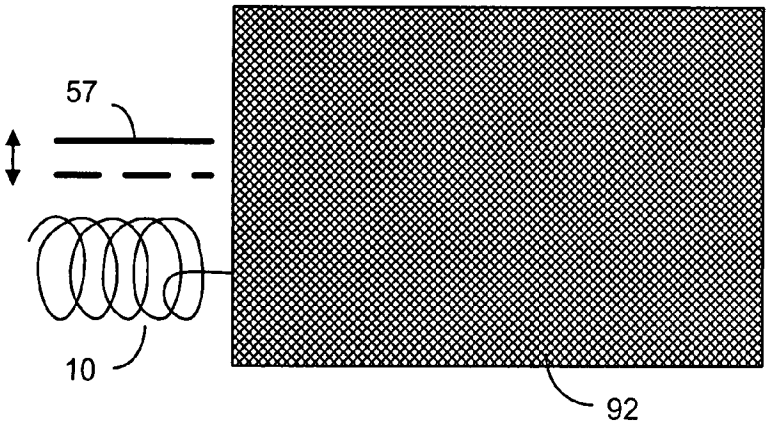
FIG. 12*a* is a schematic representation of a helix antenna mechanically tuned by moving a conductive member located adjacent to the helix.
Figure 12C:
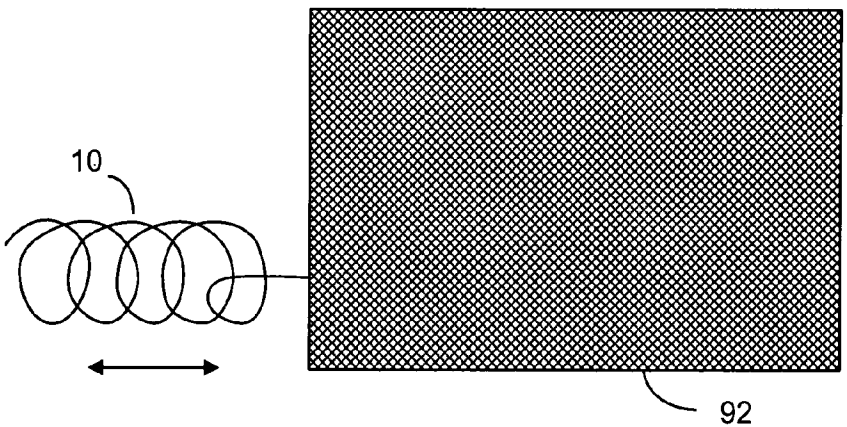
FIG. 12*c* is a schematic representation of a helix antenna mechanically tuned by changing the length of the helix.

FIGS. 12*a* to 12*c* show some of the ways to mechanically tune a helix antenna. As shown, the helix antenna has a helical conductive element 10 coupled to the ground plane 92. In order to tune such a helix antenna, a metal or dielectric/magnetic rod or plate 57 is placed adjacent to the helical element 10 for coupling. The distance between the metal or dielectric/magnetic rod or plate 57 can be changed by a mechanical device for changing the coupling, as shown in FIG. 12*a*. In a different embodiment, a metal or dielectric/magnetic object 58 is placed at least partially inside the helical element 10. A mechanical device is used to move the object 58 along a direction substantially parallel to the helix axis, as shown in FIG. 12*b*. Alternatively, the physical characteristic of the helical element 10 can be changed by stretching or compressing the helical element 10 using a mechanical device.

Figure 13B:
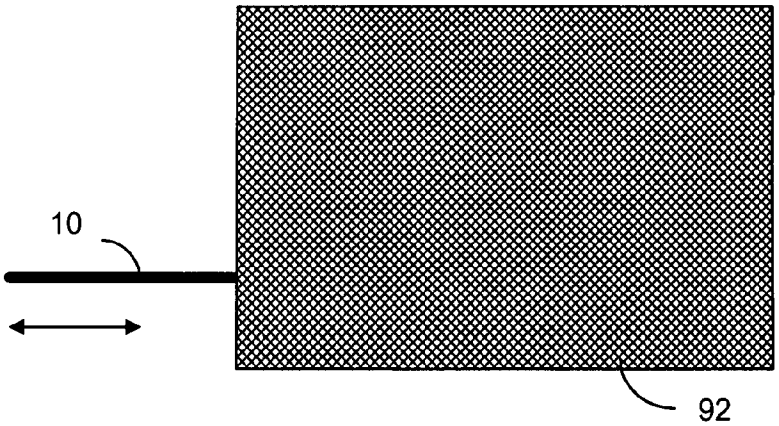
FIG. 13*b* is a schematic representation of a monopole or whip antenna mechanically tuned by changing the length of the pole.
Figure 13A:
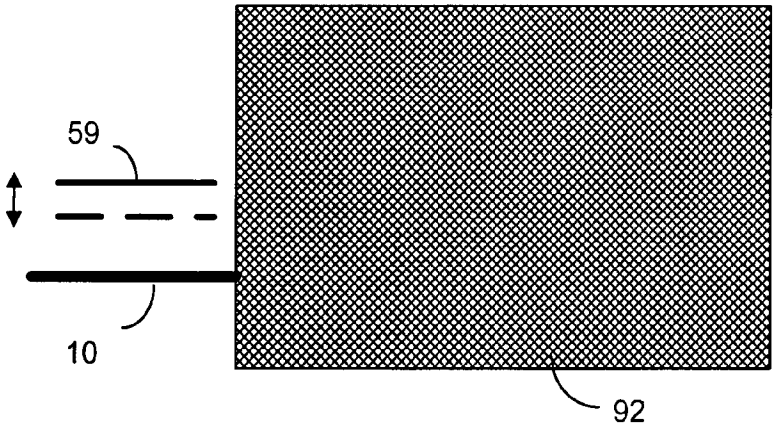
FIG. 13*a* is a schematic representation of a monopole or whip antenna mechanically tuned by moving a conductive member located adjacent to the pole.

FIGS. 13*a* and 13*b* show some of the ways to mechanically tune a monopole or whip antenna. As shown in FIG. 13*a*, a metal or dielectric/magnetic plate or rod 59 is placed adjacent to a linear antenna element 10 for coupling. The distance between the plate or rod 59 and the antenna element 10 can be increased or decreased by a mechanical device in order to change the coupling. Alternatively, the plate or rod 59 can be bent or tilted by a mechanical device. As shown in FIG. 13*b*, the linear antenna element 10 is a telescopic whip which can be motorized to adjust the length. The same arrangement may also be applicable to other antenna types such dipoles.

Figure 14A:
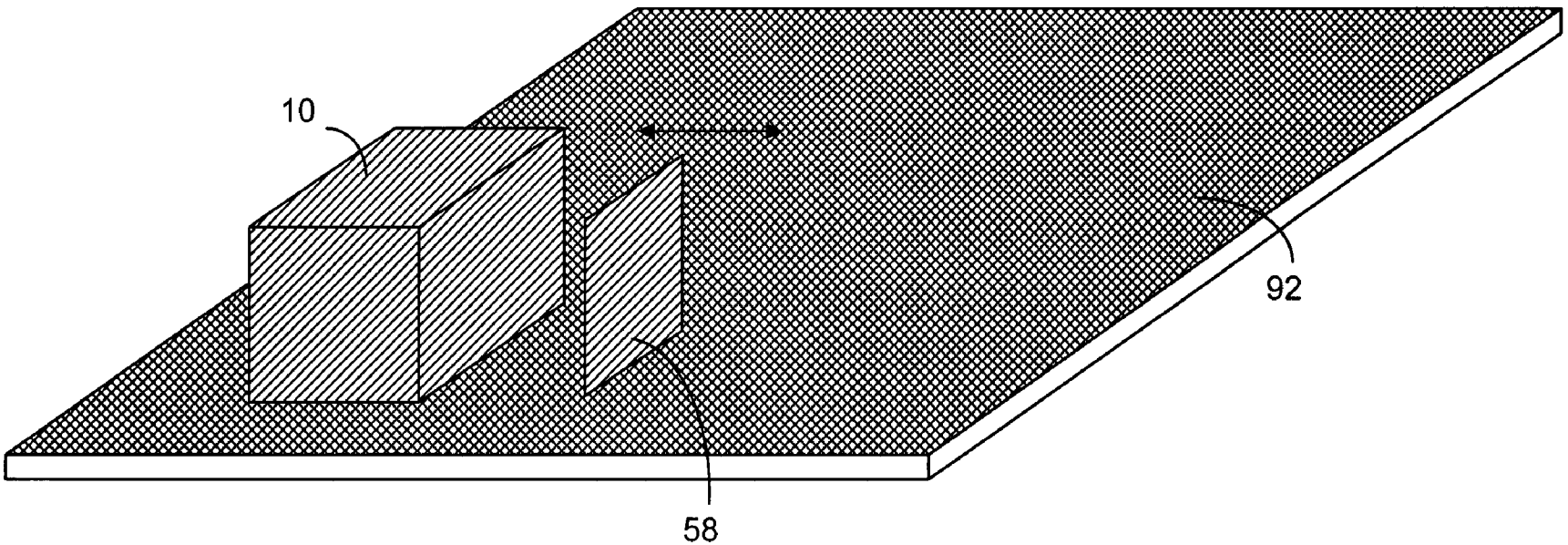
FIG. 14*a* is a schematic representation of a ceramic or dielectric resonator antenna (DRA) coupled to a metal plate that can be moved closer to or further from the antenna.
Figure 14B:
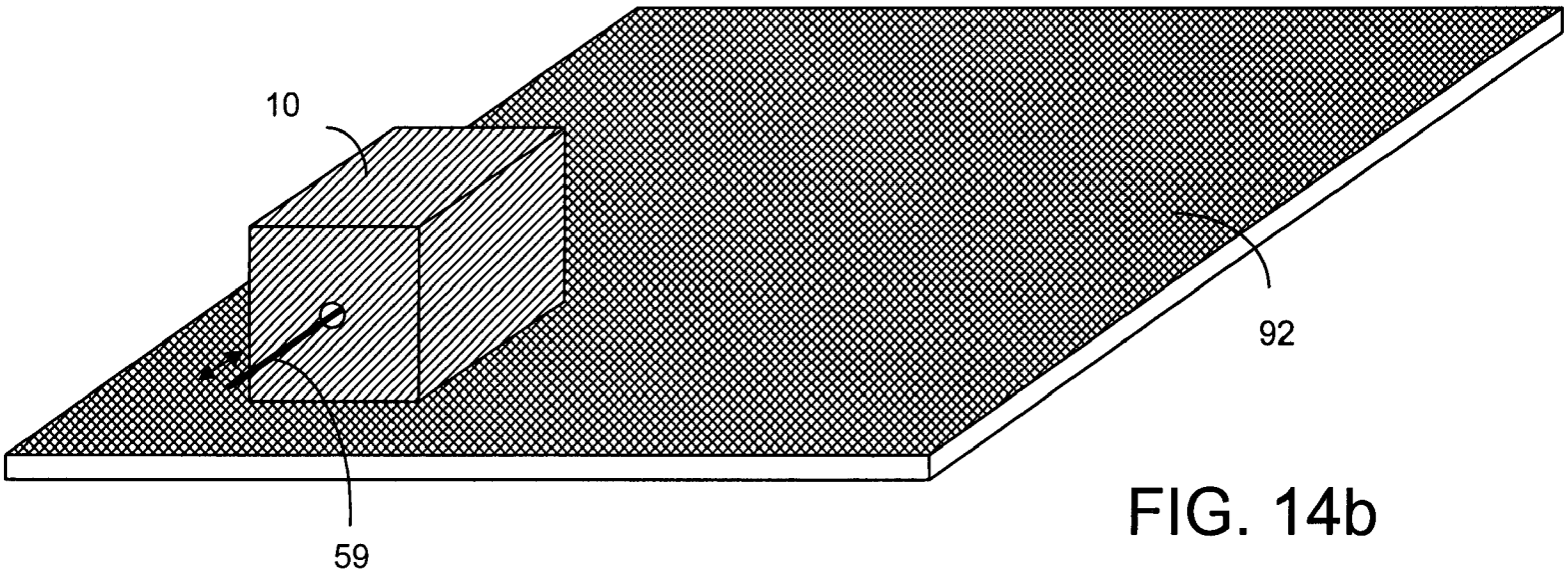
FIG. 14*b* is a schematic representation of a DRA wherein a metallic rod can be moved in a hole in the ceramic block in a direction substantially parallel to a ground plane.
Figure 14C:
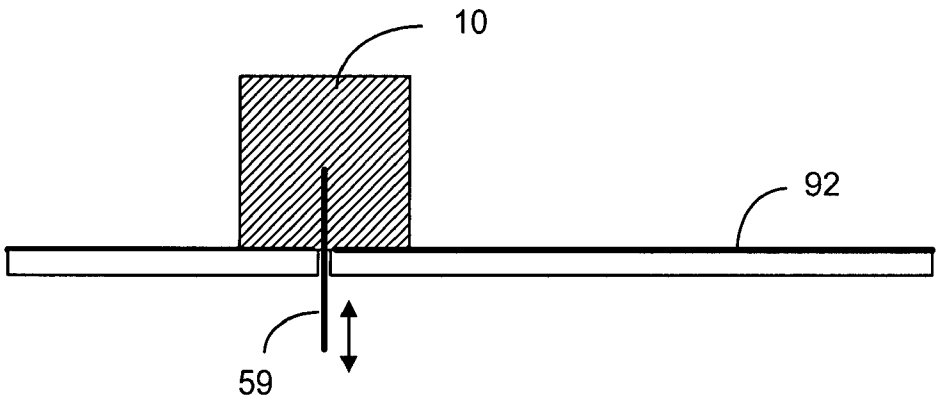
FIG. 14*c* is a schematic representation of a DRA wherein a metallic rod can be moved in a hole in the ceramic block in a direction substantially perpendicular to the ground plane.

FIGS. 14*a* to 14*c* show some of the ways to mechanically tune a ceramic or dielectric resonator antenna (DRA) 10 comprising an electrically non-conductive block and possibly conductive parts, according to some embodiments of the present invention. As shown in FIG. 14*a*, a metal or dielectric/magnetic plate or rod 58 is placed adjacent to the antenna element 10 for coupling. The metal or dielectric/magnetic plate or rod 58 can be moved by a mechanical device so that the distance between the antenna element 10 and the plate or rod 58 can be increased or shortened. As shown in FIG. 14*b*, a metal or dielectric/magnetic rod 59 can be inserted into the ceramic block through a hole to change the physical characteristic of the antenna element 10. The insertion depth of the rod 59 can be adjusted by a movement direction substantially parallel to the ground plane 92. Alternatively, the insertion depth of the rod 59 can be adjusted by a movement direction substantially perpendicular to the ground plane, as shown in FIG. 14*c*. It should be noted that the insertion of the rod 59 can also be made into the antenna element 10 at different angles relative to the ground plane 92.

Figure 15:
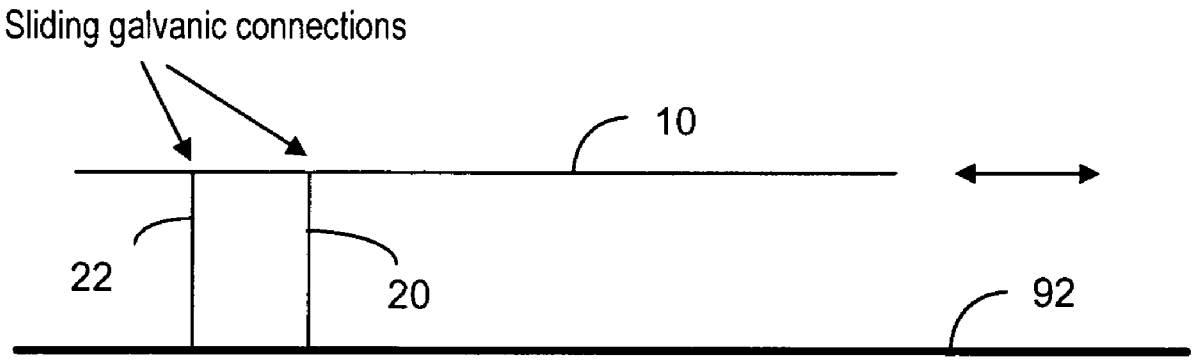
FIG. 15 is a schematic representation of an inverted-F antenna wherein the radiating element can be shifted in a linear motion with respect to the shorting pin and the feed pin.

In an inverted-F antenna, the antenna element 10 is operatively connected to a feed pin 20 and a shorting pin 22. According to one embodiment of the present invention, the electrical contacts between the antenna element 10 and pins 20, 22 are not fixed. In order to mechanically tune the inverted-F antenna, a mechanical device is used to shift the antenna element 10 in a lateral direction with respect to the shorting and feed pins, as shown in FIG. 15. The same arrangement is also applicable to an inverted-L antenna which does not have a grounding pin.

Figure 16:
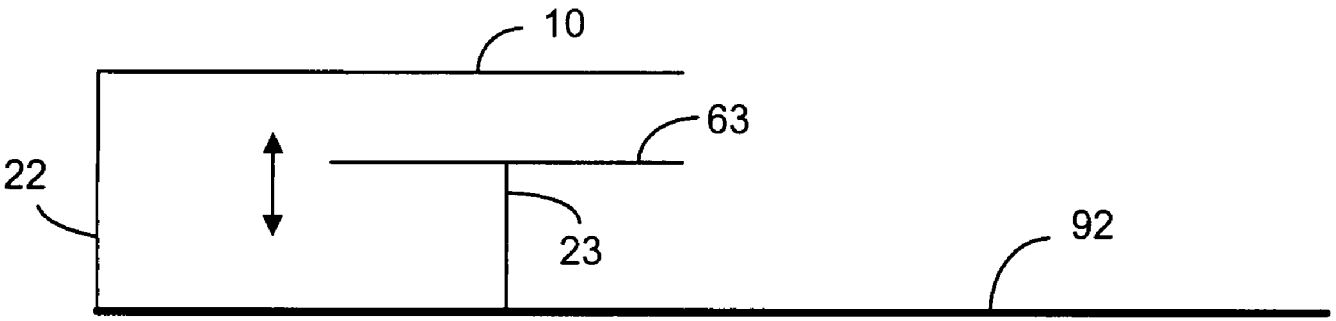
FIG. 16 is a schematic representation of an antenna having a capacitive feed under the radiating element wherein the capacitive feed can be raised or lowered through an extendable feed pin.
Figure 17B:
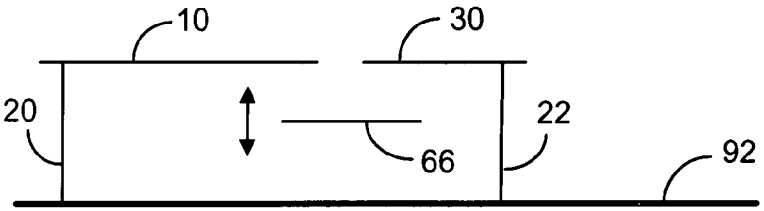
FIG. 17*b* is a side view of the antenna of FIG. 17*a*.
Figure 17A:
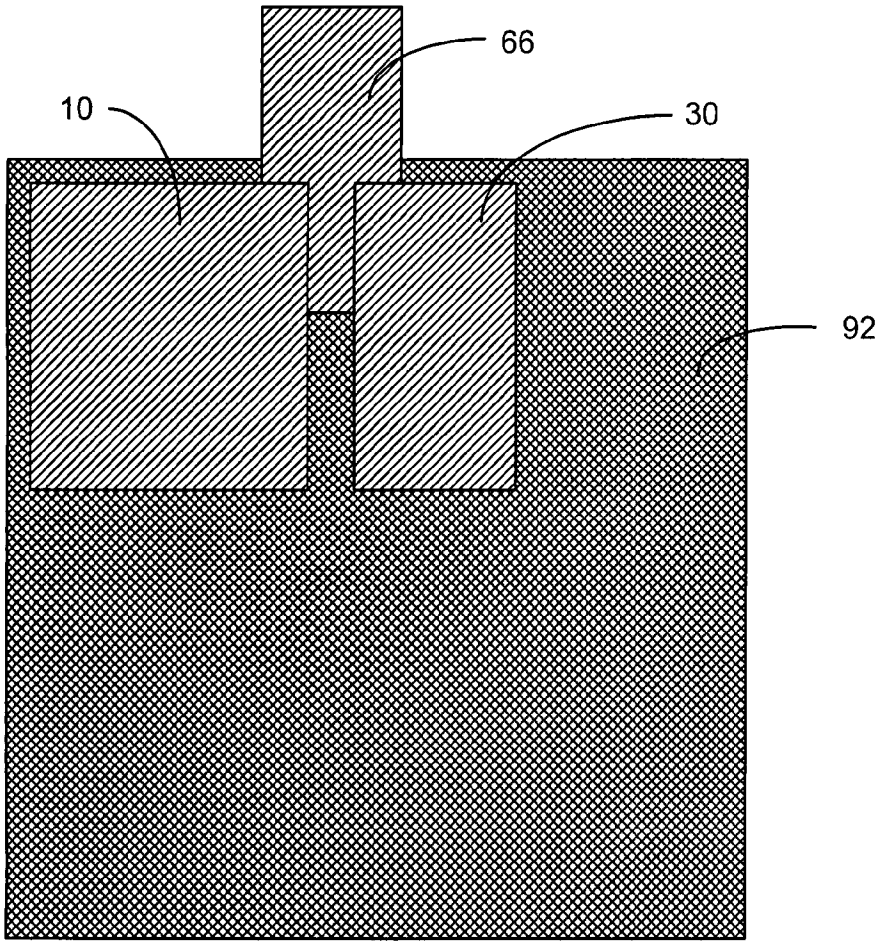
FIG. 17*a* is a schematic representation of an antenna having a radiating element and a parasitic element with a capacitive coupling plate that can be lowered or raised or moved laterally.

In a different embodiment of the present invention, the antenna is mechanically tuned by adjusting a capacitive feed plate. As shown in FIG. 16, a capacitive feed plate 63 is placed between the antenna element 10 and the ground plane 92. The capacitive feed plate 63 is connected to an extendable feed pin 23 so that the distance between the capacitive feed plate 63 can be mechanically adjusted by changing the length of the extendable feed pin 23. In this arrangement, the grounding pin 22 is optional. The feed pin can be extended, stretched, or pulled to change it's position relative to the antenna element 10. In a different embodiment, the capacitive coupling between the antenna element 10 and a metal parasitic element 30 can be changed by adjusting the placement of a metal plate 66 between the antenna element 10 and the parasitic element 30, as shown in FIGS. 17*a* and 17*b*. The metal plate 66 can be moved in, out, up and down.

In yet another embodiment of the present invention, the antenna is mechanically tuned using a slidable capacitive or galvanic connector. As shown in FIG. 18*a*, the antenna element 10 may be connected to shorting pin 22 to the ground plane 92. A row of metal segments 15 are fixedly attached to the antenna element 10. A slidable capacitive or galvanic connector 160 is used to provide capacitive feed or galvanic feed to the antenna element 10. As shown in FIG. 18*b*, the connector 160 comprises a rod made of an insulating material and an electrically conductive core connected to a feed cable 24. The connector 160 further comprises one or more metal patches 64 on the rod surface with each of the patches electrically connected to the conductive core. The connector 160 can be moved by a mechanical device so that one or more of the metal patches can make contacts to one or more metal segments 15 to provide galvanic feed to the antenna element 10 at different contacting positions. Alternatively, the connector 160 is placed adjacent to the metal segments to provide capacitive feed to the antenna element 10.

The tuning of the antenna can also be achieved by mechanically tuning a ground plane as shown in FIGS. 19*a* and 19*b*. As shown in FIG. 19*a*, a flexible tuning element such as a metal strip 192 is located on a section of the ground plane 92. The shape of the metal strip 192 can be bent by a mechanical device to change the coupling between the antenna element 10 and the ground plane 92. In a different embodiment, the ground plane 92 has a slot 93 and a slidable metal plate 193 can be caused by a mechanical device to change the physical characteristic and the operation of the slot 193, as shown in FIG. 19*b*.

Figure 20A:
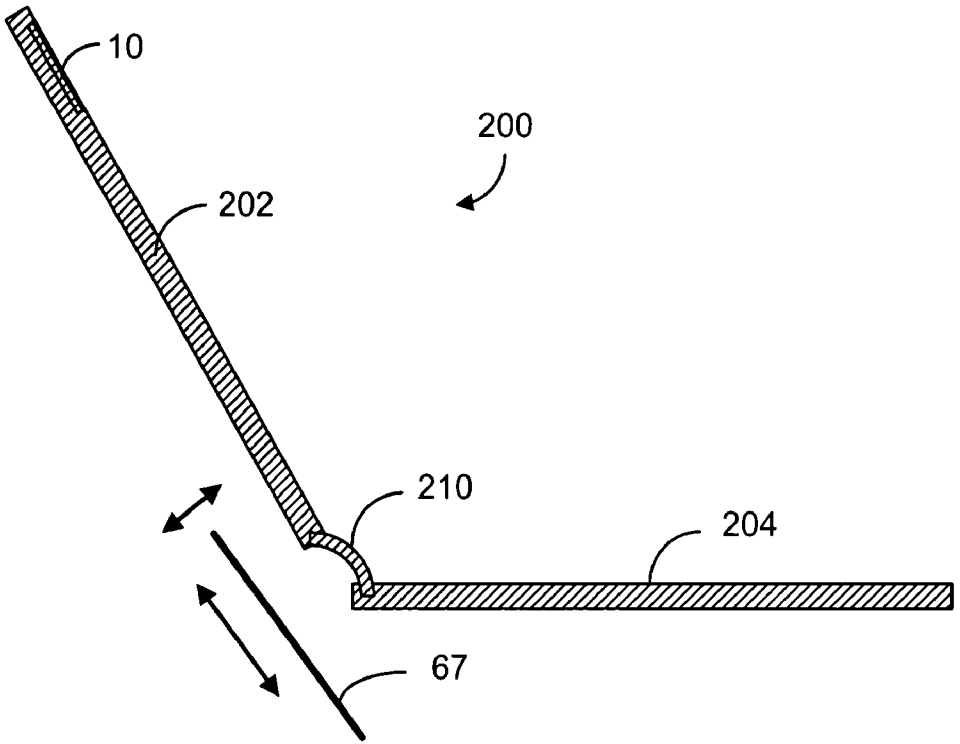
FIG. 20*a* is a schematic representation of a clamshell phone having a metal plate for changing the coupling of the clamshell parts.

The tuning of the antenna can also be achieved by changing the coupling between different device parts of a mobile phone, for example. In a clamshell phone 200 having an upper part 202 and a lower part 204 rotatably coupled to each other by a mechanical hinge and electrically connected by a flexible connector 210, a mechanically moveable metal plate 67 is placed adjacent to the upper and lower parts in order to change the coupling between the parts, as shown in FIG. 20*a*. In a slide phone 201 having a slidable upper part 206 and a lower part 206 electrically connected to each other by a flexible connector 212, a metal plate or a dielectric/magnetic object 69 is disposed between the upper and lower parts. The object 69 can be mechanically shifted in various directions in order to change the coupling between the parts.

Figure 20B:
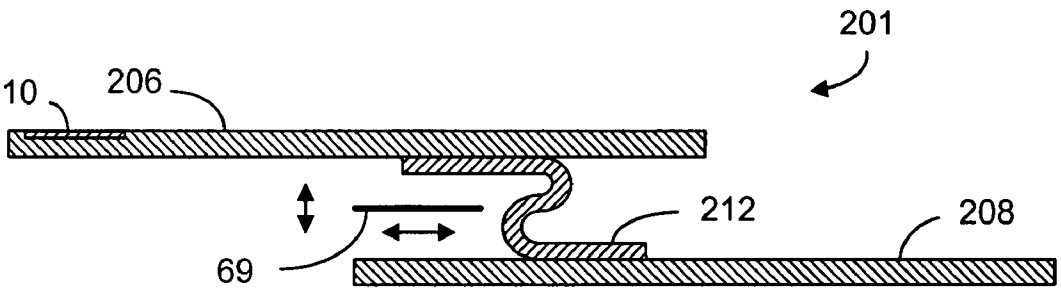
FIG. 20*b* is a schematic representation of a slide phone having a metal plate for changing the coupling of the slidable parts.
Figure 21B:
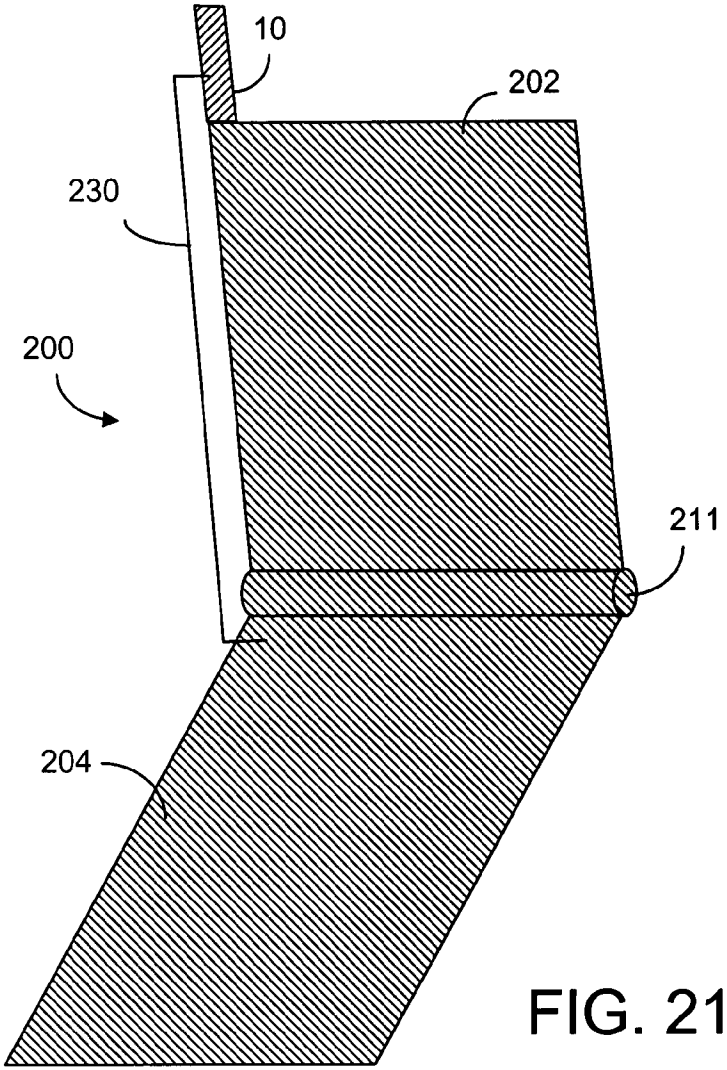
FIG. 21*b* is a schematic representation of the foldable phone showing the antenna element when the phone is in an open position.
Figure 21A:
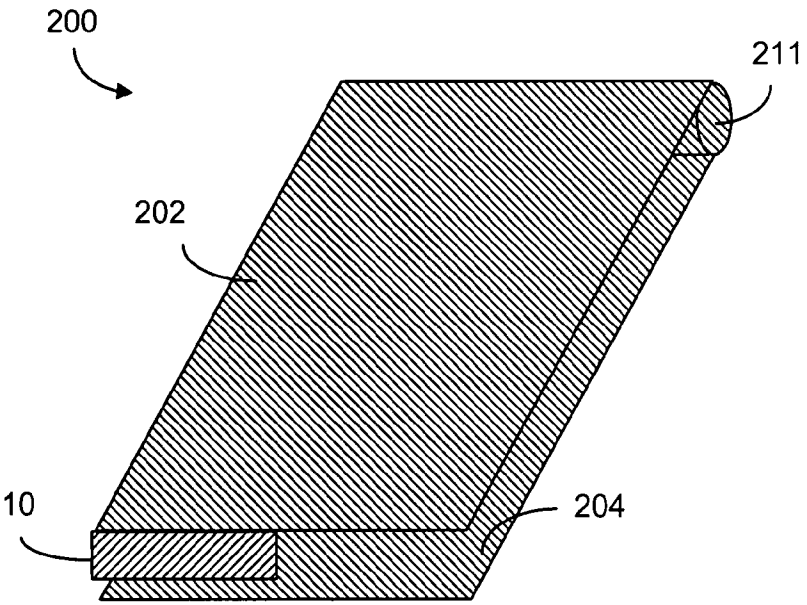
FIG. 21*a* a schematic representation of a foldable phone showing the antenna element when the phone is in a closed position.

In the clamshell phone 200 or the slide phone 201 as illustrated in FIGS. 20*a* and 20*b*, the relative movement between the upper and lower parts can be used to change the position of an antenna element. For example, in the clamshell phone 200 as shown in FIG. 21*a*, the antenna element 10 is oriented such that its longitudinal axis is substantially parallel to the hinge 211 when the phone is in a closed position. When the phone is in an open position, it is possible to use a mechanical device, such as a spring 230 to change the orientation of the antenna element 10 in order to shift the frequency bands of the phone or the operating impedance of the antenna element. For example, the antenna element 10 can be caused to change its orientation such that its longitudinal axis is substantially perpendicular to the hinge 211.

Figure 23B:
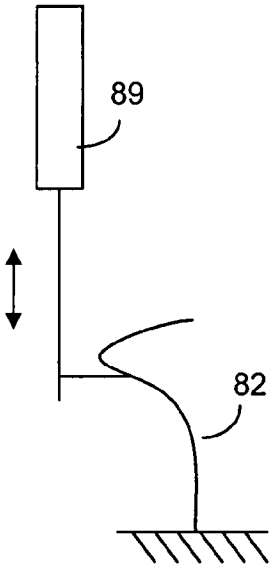
FIG. 23*b* shows one way to lock a linear actuator
Figure 24:
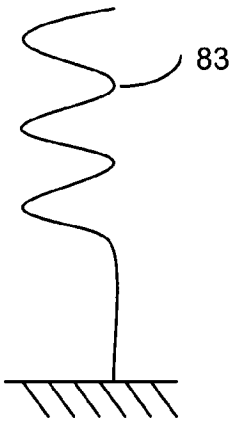
FIG. 24 shows a multi-state spring clamp.
Figure 22:
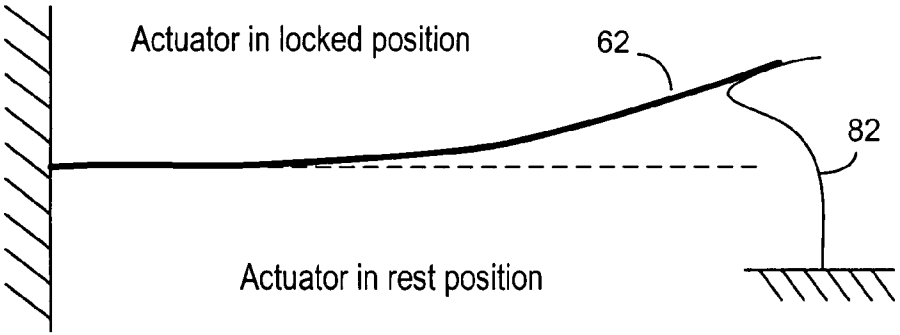
FIG. 22 shows one way to lock an actuator.
Figure 23A:
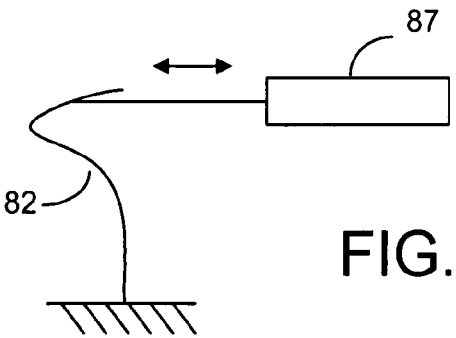
FIG. 23*a* show a method for releasing a spring clamp.

In the embodiments where an actuator is caused to bend in order to effect a change in the physical characteristic of a mechanically tuned antenna, it is desirable and advantageous that one or two positions of the actuator can be locked in order to maintain a certain tuned position of the antenna while eliminating the need for supplying a continuous current to the mechanical device that changes the position of the actuator. For example, the actuator 62 (see FIGS. 4, 5*a*, 5*b* and 8*a*) can be kept at a locked position by a spring clamp 82, as shown in FIG. 22, when the actuator 62 is bent. To return to its rest position, a negative voltage can be applied to the actuator 62 in order to force the actuator to move downward so that the tip of the actuator slips off the spring clamp 82. The spring clamp 82 can also be moved by another actuator or a motor to release the locked actuator, as shown in FIG. 23*a*. FIG. 23*b* shows how a spring clamp 82 can be used to lock the movement of a linear actuator 89. When it is desirable to have two or more locked positions for the actuator, a multi-state spring clamp 83 as shown in FIG. 24 can be used, for example. Alternatively, bistable materials that lock in two different states can be used, thereby eliminating the need of any locking mechanism.

Figure 25:
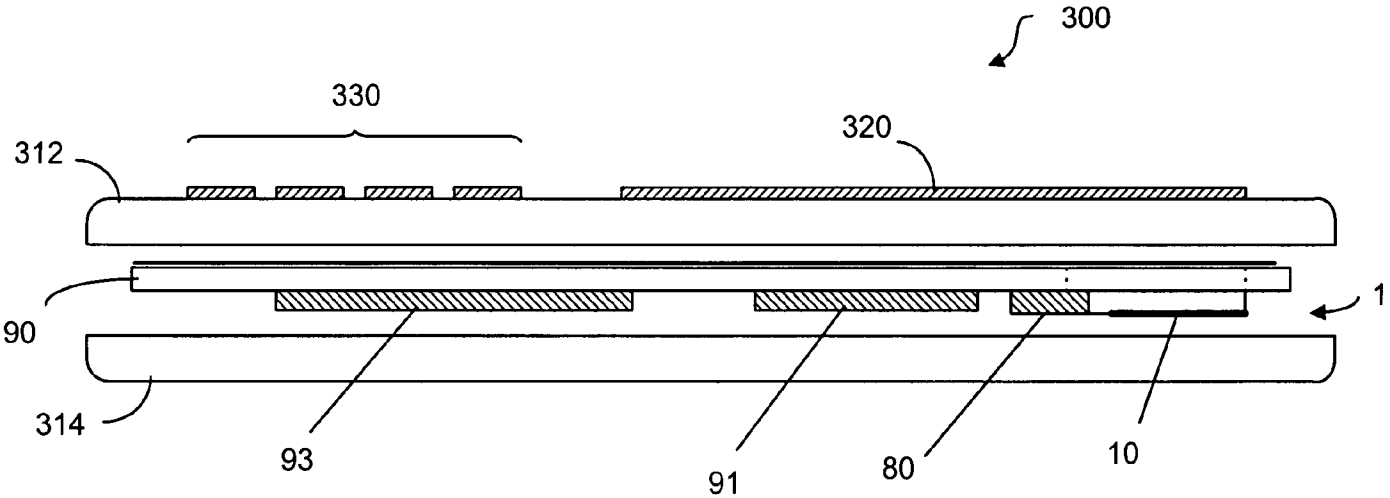
FIG. 25 is a schematic representation of a mobile phone having a mechanically tunable antenna, according to various embodiments of the present invention.

A mechanically tunable antenna, according to various embodiments of the present invention, can be used in a mobile phone so that the same antenna can be used to cover different frequency bands. FIG. 25 is a schematic representation of such a mobile phone. As shown in FIG. 25, the mobile phone 300 has an upper part 312 and a lower part 314 to accommodate the circuit board 90. The mobile phone 300 comprises a keypad 330 and a display module 320 disposed on the upper part 330. The mobile phone 300 has a mechanically tunable antenna which comprises an antenna element 10 disposed on the circuit board 90. A mechanical device 80 is disposed adjacent to the antenna element 10 to change the physical characteristic of the antenna element 10 for tuning the antenna. The mobile phone 300 also comprises an RF front end 91 and a signal processor 93 on the circuit board. The antenna element 10 can be caused to change it's shape by the mechanical device. Alternatively, the mechanical device is used to change the coupling between the antenna element and an adjacent object.

It should be noted that the metal plate that is placed adjacent to an antenna element for tuning can be bent by using an actuator or motor, for example. However, the metal plate can be covered by an actuator so that the metal plate can be bent along with the actuator. Furthermore, the coupling between the antenna element and the metal plate can also be changed by using an actuator having a changeable thickness or an actuator having a changeable size and shape.

In sum, the present invention provides a method of tuning a radio antenna for used in a communication device, such as a mobile phone. In a radio antenna having at least one radiating element, the method uses a mechanical device to change the physical characteristic of the radiating element in relation to a ground plane in order to shift the frequency band of the radio antenna or to change the operating impedance of the radiating element. In some embodiments, the method comprises using the mechanical device to change the shape of the radiating element. In other embodiments, the mechanic device is used to shift a physical object or member disposed adjacent to the radiating element in order to change the coupling between the radiating element and that physical object and/or to change the coupling between the radiating element and a ground plane. The physical object can be an electrically conducting strip, rod or plate, or can be made of a dielectric or magnetic material. In a communication device having two or more device parts, the relative position of the device parts can be mechanically changed by a user and the changes in the relative position can be used to affect the physical characteristic of the antenna.

Mobile phones usually have antennas that are required to cover many frequency bands. For example, the GSM antenna may have to cover four bands, namely the two European bands called GSM 900 (880-960 MHz) and GSM 1800 (1710-1880 MHz), and two US bands called GSM 850 (824-894 MHz) and GSM 1900 (1850-1990 MHz). It is advantageous and desirable to provide an antenna which can be tuned between two states, wherein the European state covers GSM 900 and GSM 1800 and the US state covers GSM 850 and GSM 1900, for example. It may be desirable to cover other bands or protocols too, for example, CDMA, PDC, WCDMA, BLUETOOTH, WLAN, HLAN, GPS, WiMax, UWB, FM, RFID, DVB-H, DRM, DAB, AM and other Cellular and Non-Cellular radio systems not mentioned here. As well as mobile phones, other electronic devices, both mobile and static, can benefit from the present invention as it is applicable to all kinds of antenna implementations in a variety of systems. Base Stations, Access Points, and other electronic devices can use the various antenna assemblies of the present invention to improve upon standard antenna designs within a given space. This invention, although centered on the example of a mobile phone implementation, is by no means restricted to mobile phones.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A radio antenna, comprising:

a radiating element electromagnetically coupled to a ground plane; and a tuning element located at a lateral distance from the radiating element, wherein the tuning element is coupled to a mechanical device for adjusting the lateral distance, wherein the ground plane comprises a slot having a slot area, and wherein the tuning element comprises a plate for changing the slot area.

2. A communication device, comprising a radio antenna as defined in claim 1.

3. A communication device according to claim 2, comprising a mobile terminal.

4. A radio antenna according to claim 1, wherein the mechanical device is an actuator.

5. A radio antenna according to claim 1, wherein the mechanical device is a motor.

6. A radio antenna according to claim 1, wherein the plate is a metal plate.

7. A radio antenna, comprising:

a radiating element electromagnetically coupled to a ground plane; and a tuning element located at a lateral distance from the radiating element, wherein the tuning element is coupled to a mechanical device for adjusting the lateral distance, wherein the radiating element is disposed on a first device part, the first device part movably coupled to a second device part, wherein the tuning element is located adjacent to the first device part and the second device part for changing a physical relationship between the first device part and the second device part.

8. A radio antenna according to claim 7, wherein the mechanical device is an actuator.

9. A radio antenna according to claim 7, wherein the mechanical device is a motor.

10. A radio antenna according to claim 7, wherein changing the physical relationship between the first device part and the second device part causes an electromagnetic coupling between the first device part and the second device part to change.

11. A radio antenna according to claim 7, wherein the radio antenna is comprised within a clamshell phone and the first device part and the second device part are an upper part and a lower part of the clamshell phone, wherein the upper part and lower part are rotatably coupled to each other by a mechanical hinge and electrically connected to each other by a flexible connector.

12. A radio antenna according to claim 7, wherein the radio antenna is comprised within a slide phone and the first device part and the second device part are an upper part and a lower part of the slide phone, wherein the upper part and the lower part are slidably coupled to each other.

13. A radio antenna according to claim 7, wherein a relative movement between the first device part and the second device part causes a position of the radiating element to change.

* * * * *

UNITED STATES PATENT AND TRADEMARK OFFICE

CERTIFICATE OF CORRECTION

PATENT NO. : 7,755,547 B2
APPLICATION NO. : 11/478839
DATED : July 13, 2010
INVENTOR(S) : Jussi Rahola et al.

It is certified that error appears in the above-identified patent and that said Letters Patent is hereby corrected as shown below:

On the Title Page, Item (75), the third inventor's name should read:

"Kenichi Hashizume"

Signed and Sealed this

Fourteenth Day of September, 2010

David J. Kappos

David J. Kappos
*Director of the United States Patent and Trademark Office*